US005788542A

United States Patent [19]

Miwa

[11] Patent Number: 5,788,542

[45] Date of Patent: Aug. 4, 1998

[54] FEMALE TERMINAL

[75] Inventor: Takeya Miwa, Shizuoka-ken, Japan

[73] Assignee: Yazaki Corporation, Tokyo, Japan

[21] Appl. No.: 645,351

[22] Filed: May 13, 1996

[30] Foreign Application Priority Data

May 26, 1995 [JP] Japan ..... 7-127735

[51] Int. Cl.[6] ..... H01R 11/22

[52] U.S. Cl. ..... 439/851

[58] Field of Search ..... 439/850–856, 439/861, 862, 839

[56] References Cited

U.S. PATENT DOCUMENTS

| | | | |
|---|---|---|---|
| 5,288,252 | 2/1994 | Steinhardt et al. | 439/851 |
| 5,360,356 | 11/1994 | May et al. | 439/851 |
| 5,540,603 | 7/1996 | Fujiwara | 439/850 |
| 5,601,458 | 2/1997 | Ohsumi et al. | 439/851 |
| 5,611,715 | 3/1997 | Samejima | 439/851 |

FOREIGN PATENT DOCUMENTS

| | | |
|---|---|---|
| 64-16074 | 1/1989 | Japan . |
| 1-106084 | 7/1989 | Japan . |

*Primary Examiner*—Hien Vu

*Attorney, Agent, or Firm*—Finnegan, Henderson, Farabow, Garrett & Dunner, L.L.P.

[57] ABSTRACT

A female terminal formed by folding a piece of plate material has an electrical contact portion of a substantially quandrangular prism, which has a bottom plate portion and an opening and into which a flat male terminal is inserted through the opening for establishing an electrical connection between the male terminal and the female terminal. The female terminal also has a resilient contact piece which is formed in the electrical contact portion by folding an end portion of the bottom plate portion and which has a bent portion. In order to protect the bent portion of the resilient contact piece, a protecting wall portion for preventing the male terminal from contacting the bent portion of the resilient contact piece is so arranged as to cover a lower portion of the opening of the electrical contact portion.

6 Claims, 4 Drawing Sheets

FEMALE TERMINAL

BACKGROUND OF THE INVENTION

1. Field of the Invention

The present invention relates generally to a female terminal which has an electrical contact portion of a quadrangular prism formed by folding a piece of plate material and into which a flat male terminal is inserted for establishing an electrical connection between the male terminal and the female terminal. More specifically, the invention relates to a female terminal which has a resilient contact piece formed by folding an end portion of a bottom plate of the electrical contact portion.

2. Description of the Prior Art

One of female terminals of this type is disclosed in Japanese Utility Model Laid-Open No. 1-106084. This female terminal is formed with an electrical contact portion of a substantially quandrangular prism on one side thereof. On the other side of the female terminal, a caulked connecting portion for connecting the female terminal to an electric wire W is formed. The electrical contact portion has a resilient contact piece formed by folding an end portion of a bottom plate portion thereof. Between the resilient contact piece and the bottom plate portion, a forward pinch preventing portion and a rearward pinch preventing portion are formed by folding a free end portion of the resilient contact piece.

When a male terminal of a flat plate is inserted between the resilient contact piece and a wall portion facing the bottom plate portion, the resilient contact piece is bent toward the bottom plate portion to hold the male terminal between the wall portion and the resilient contact piece by a predetermined contact pressure, so that the male terminal is electrically brought into contact with the female terminal.

Since the forward and rearward pinch preventing portions can prevent the excessive deformation of the resilient contact piece, it is possible to prevent the resilient contact piece from being permanently bent so as not to spoil the function as a female terminal.

However, if external force (impact force) is applied to a bent portion of the resilient contact piece when the female terminal is transported before it is mounted in a housing, there is a problem in that the resilient contact piece is deformed. In addition, even if the female terminal is mounted in a housing, in a case where a cut-out for inserting therein a terminal drawing tool is formed in the front of the housing, there is a problem in that the terminal drawing tool contacts the bent portion of the resilient contact piece to deform the resilient contact piece.

SUMMARY OF THE INVENTION

It is therefore an object of the present invention to eliminate the aforementioned problems and to provide a female terminal which can prevent a bent portion of a resilient contact piece from being deformed.

In order to accomplish the aforementioned and other objects, a female terminal formed by folding a piece of plate material, according to the present invention, comprises: an electrical contact portion of a substantially quandrangular prism, which has a bottom plate portion and an opening and into which a flat male terminal is inserted through the opening for establishing an electrical connection between the male terminal and the female terminal; a resilient contact piece formed in the electrical contact portion by folding an end portion of the bottom plate portion, the resilient contact piece having a bent portion; and a protecting wall portion arranged at the opening of the electrical contact portion for protecting the bent portion of the resilient contact piece. With this construction, even if external force is applied to the electrical contact portion during the transportation thereof and so forth before it is mounted in a housing, the female terminal is not deformed since the resilient contact piece is protected by the protecting wall portion.

The protecting wall portion may have an extending portion which extends toward the resilient contact piece. In this case, even if a male terminal is inserted into the electrical contact portion of female terminal while it is inclined with respect to the electrical contact portion, the inclined male terminal first contacts the extending portion of the protecting wall portion, and then, it contacts a portion of the resilient contact piece below which a pinch preventing portion is formed, so that the deformation of the resilient contact piece can be prevented.

The female terminal may further comprise a pinch preventing portion formed by bending a free end portion of the resilient contact piece downwards. In this case, even if a male terminal is inserted into the electrical contact portion of the female terminal while it is inclined with respect to the electrical contact portion, the deformation of the resilient contact piece can be prevented by the pinch preventing portion.

In addition, the protecting wall portion may be so arranged as to cover a lower portion of the opening of the electrical contact portion. The protecting wall portion may be also formed by folding a pair of extending wall portions which extend from side wall portions of the electrical contact portion.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Referring now to the accompanying drawings, particularly to FIGS. 1 through 4, the preferred embodiment of a female terminal according to the present invention will be described below.

Figure 1A:
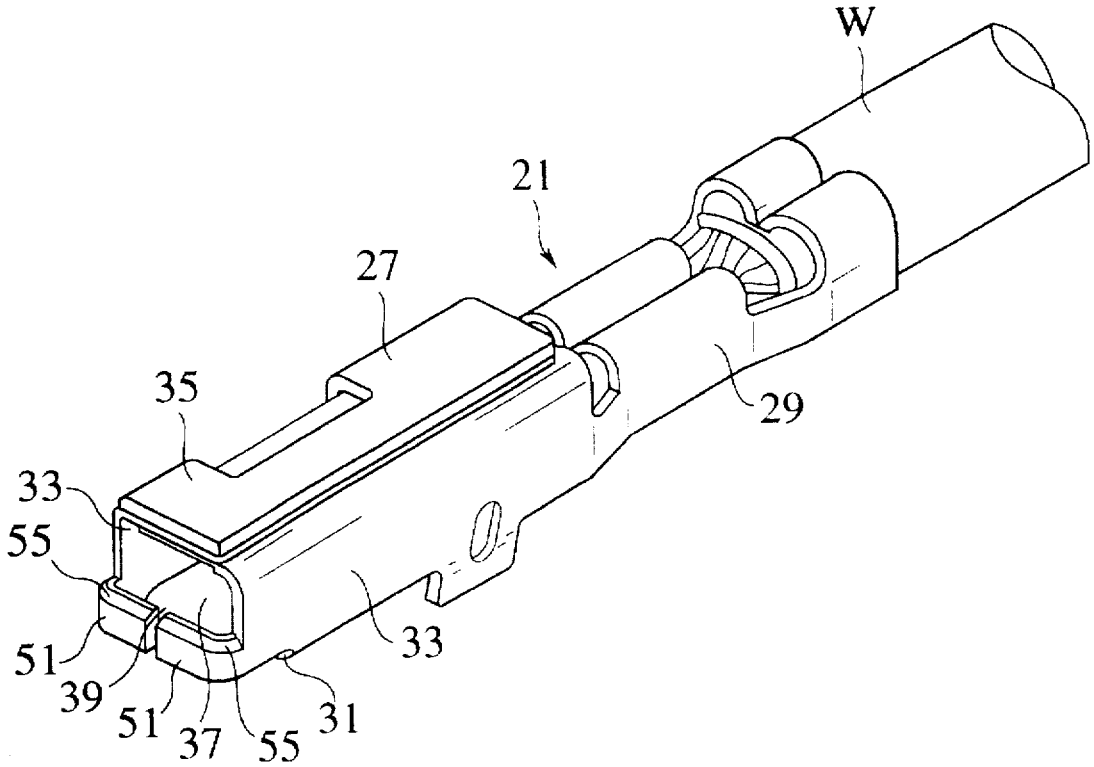
FIG. 1A is a perspective view of the preferred embodiment of a female terminal according to the present invention.
Figure 1B:
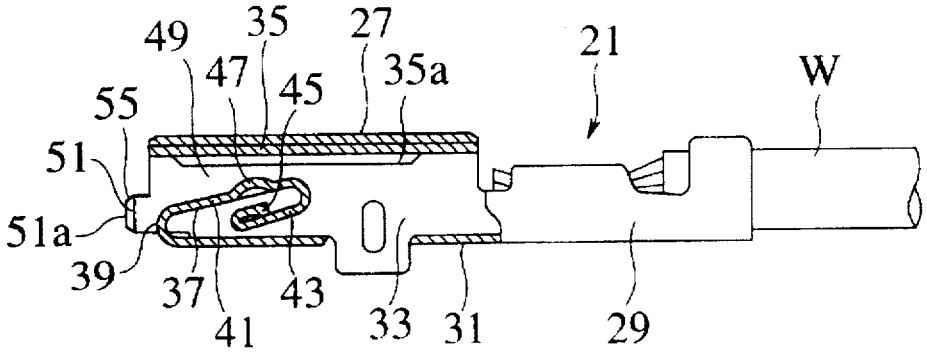
FIG. 1B is a sectional view showing the interior of the female terminal of FIG. 1A.
Figure 2A:
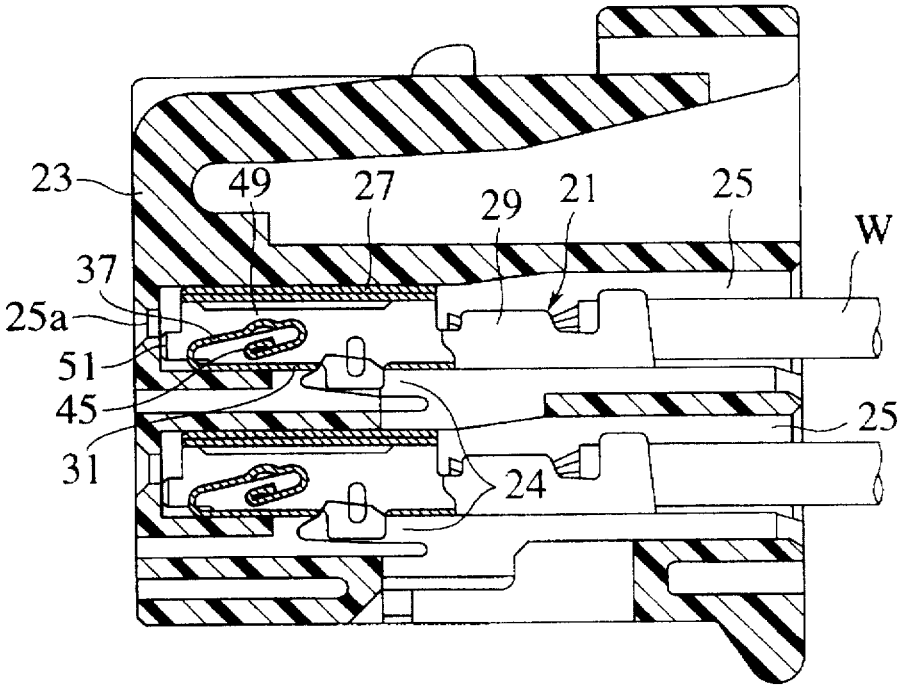
FIG. 2A is a sectional view of a housing and the female terminal of FIG. 1A received in the housing.
Figure 2B:
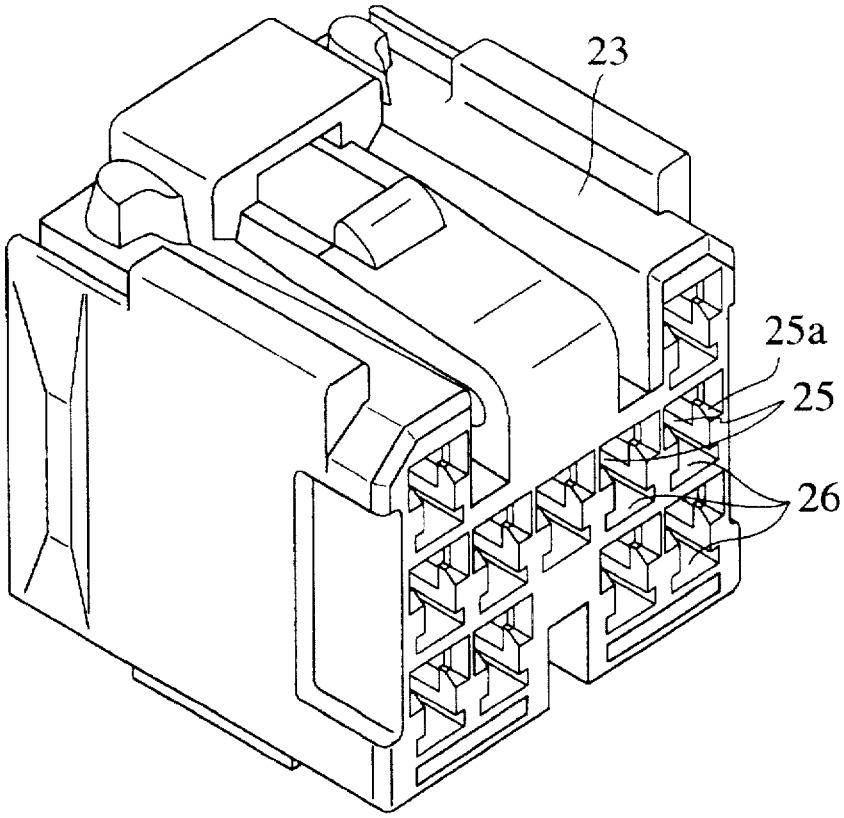
FIG. 2B is a perspective view of the housing of FIG. 2A.
Figure 3:
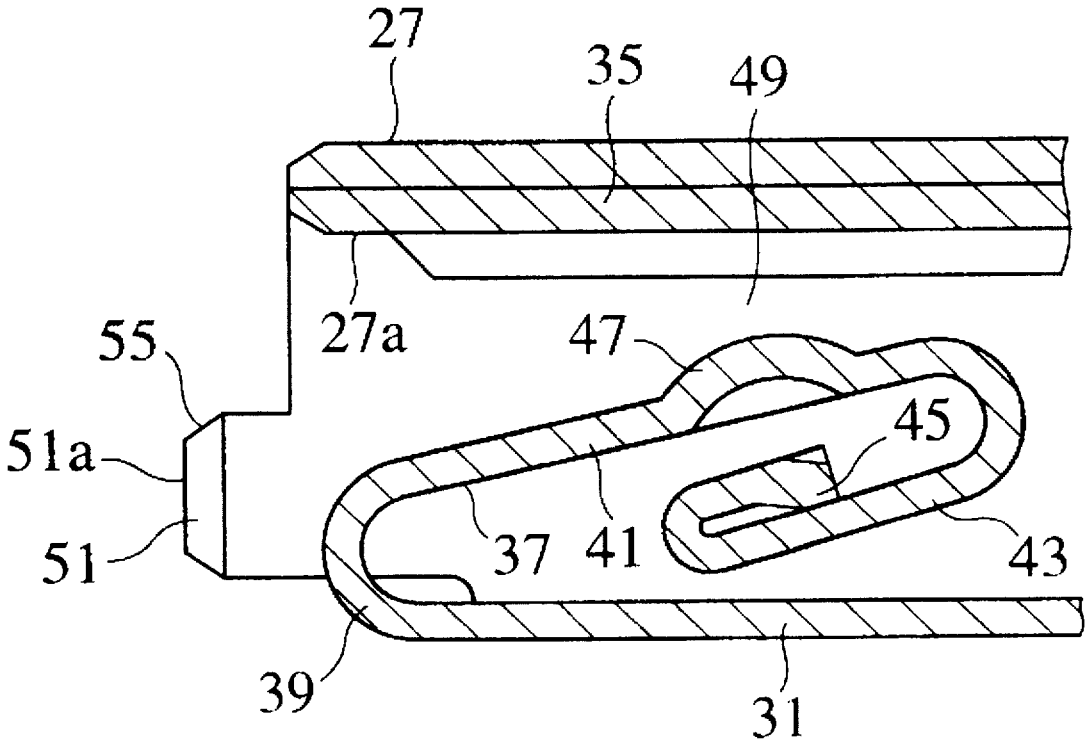
FIG. 3 is an enlarged sectional view of a part of an electrical contact portion of the female terminal of FIG. 1A.

FIG. 1A is a perspective view of the preferred embodiment of a female terminal 21 according to the present invention, and FIG. 1B is a sectional view showing the interior of the female terminal 21. FIG. 2A is a sectional view of a housing 23 and the female terminal 21 received in a terminal chamber 25 of the housing 23, and FIG. 2B is a perspective view of the housing 23. FIG. 3 is an enlarged sectional view of a part of an electrical contact portion 27 of the female terminal 21.

As shown in FIG. 1A, the female terminal 21 comprises the electrical contact portion 27 of a substantially quadrangular prism, and a caulked connecting portion 29 designed to be connected to the end of an electric wire. The electrical contact portion 27 and the caulked connecting portion 29 are integrally formed with each other. As shown in FIGS. 1B and 3, the electrical contact portion 27 comprises a bottom plate portion 31, a pair of side walls 33 which are formed by bending both side portions of the bottom plate portion 31 in the same direction, and an upper plate portion 35 which is formed by bending these side walls 33 inwardly to place one upon another and which faces the bottom plate portion 31 so as to form a quandrangular prism. The upper plate portion 35 is formed with an embossed portion **35*a* protruding toward the electrical contact portion 27**.

In the electrical contact portion 27, a resilient contact piece 37 is formed by folding an end portion of the bottom plate portion 31. The resilient contact portion 37 comprises a bent portion 39 arranged on the forward side thereof, a contact piece portion 41 facing the upper plate portion 35, an auxiliary piece portion 43 formed by bending a free end of the contact piece portion 41 downwardly, and a pinch preventing portion 45 formed by further bending the tip portion of the auxiliary piece portion 43 into a space between the contact piece portion 41 and the auxiliary piece portion.

At the intermediate portion of the contact piece portion 41, an arched protruding portion 47 which protrudes toward the upper plate portion 35 is formed. The pinch preventing portion 45 is arranged beneath the protruding portion 47. Between the embossed portion **35*a* of the upper plate portion 35 and the contact piece portion 41, a male-terminal receiving portion 49** is formed.

At a male-terminal inserting opening **27*a* of the electrical contact portion 27, a protecting wall portion 51 for protecting the bent portion 39 of the resilient contact piece 37 is formed. As shown in FIG. 3, the protecting wall portion 51 is formed by bending the extended lower portions of the front portions of the side walls 33 of the electrical contact portion 27 inwardly. In addition, the protecting wall portion 51 is formed with an inclined plane 55 which is inclined from the front surface 51*a* on the male-terminal inserted side to the male-terminal receiving portion 49 into which the male terminal 53 is inserted. The inclined plane 55 is designed to guide the male terminal 53 toward the male-terminal receiving portion 49**.

As shown in FIG. 2A, the female terminal 21 is received in the terminal chamber 25 formed in the housing 23 to engage a resilient engaging arm 24 so as to prevent the female terminal 21 from being drawn out of the terminal chamber 25. In addition, when the female terminal 21 is received in the terminal chamber 25, the protecting wall portion 51 is arranged on the side of the male-terminal inserting opening **25*a* of the terminal chamber 25**.

As shown in FIG. 2B, the housing 23 is formed with a plurality of cut-outs 26 in the front-side openings of the respective terminal chambers 25. Through the cut-out 26, a terminal drawing tool (not shown) for forcibly bending the resilient engaging arm 24 to disengage it from the female terminal 21 is inserted into the terminal chamber 25. When the female terminal 21 is received in the terminal chamber 25, the protecting wall portion 51 is arranged on the side of the cut-out 26. Therefore, the terminal drawing tool inserted into the terminal chamber 25 from the cut-out 26 is brought into contact with the protecting wall portion 51, and it is not brought into contact with the bent portion 39.

Figure 4A:
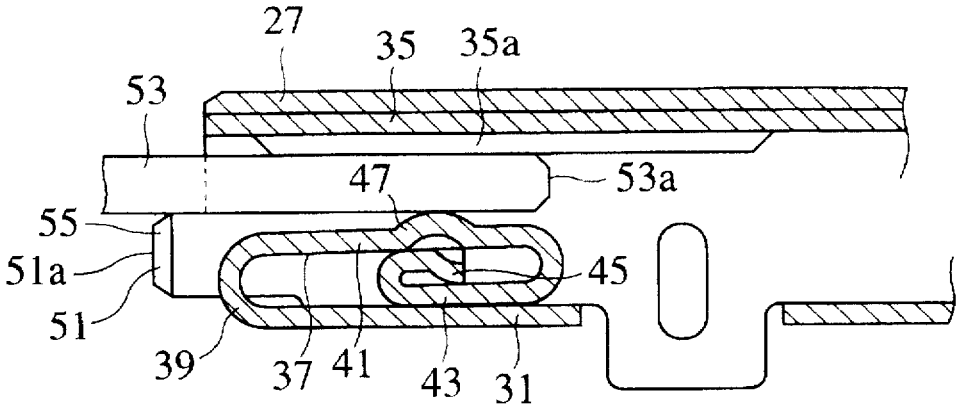
FIG. 4A is a sectional view of a part of the electrical contact portion of the female terminal of FIG. 1A when a male terminal is inserted into a male-terminal receiving portion of the female terminal.

As shown in FIG. 4A, when the male terminal 53 is inserted into the male-terminal receiving portion 49 of the female terminal 21 in the regular inserting direction, the tip portion **53*a* of the male terminal 53 contacts the contact piece portion 41 of the resilient contact piece 37. When the male terminal 53 is more deeply inserted into the male-terminal receiving portion 49, the resilient contact piece 37 is bent around the bent portion 39 toward the bottom plate portion 31, and the male terminal 53 slides on the protruding portion 47 of the contact piece portion 41. When the male terminal 53 is fully inserted into the male-terminal receiving portion 49, the male terminal 53 is held between the contact piece portion 41 and the embossed portion 35*a* of the upper plate portion 35 by a predetermined contact pressure. In this way, the female terminal 21 is electrically connected to the male terminal 53**.

Figure 4B:
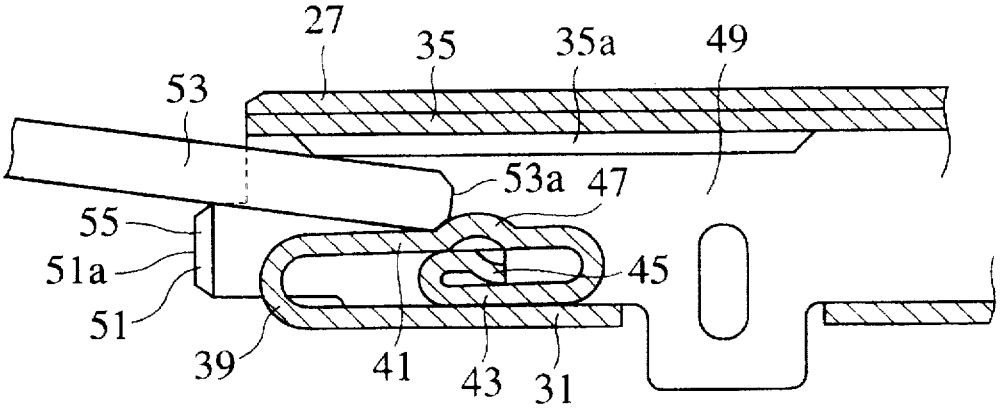
FIG. 4B is a sectional view of a part of the electrical contact portion of the female terminal of FIG. 1A when a male terminal is inclined to be inserted into a male-terminal receiving portion of the female terminal.

As shown in FIG. 4B, even if the male terminal 53 is inclined to be inserted into the male-terminal receiving portion 49, the inserting direction of the male terminal 51 is corrected by the protecting wall portion 51 and the embossed portion **35*a* immediately after the male terminal 53 is inserted into the male-terminal receiving portion 49, and the pinch preventing portion 45 acts after the tip portion 53*a* of the male terminal 53 contacts the resilient contact piece 37. Therefore, if the resilient contact piece 37 is pressed by the tip portion 53*a* of the male terminal 53**, it is not deformed.

According to this preferred embodiment of the present invention, even if external force (impact force) is applied to the female terminal 21 during the transportation thereof and so forth before it is received in the terminal chamber 25 of the housing 23, the external force is not applied to the bent portion 39 of the resilient contact piece 37 so that the resilient contact piece 37 is not deformed, since the protecting wall portion 51 is provided.

Figure 5:
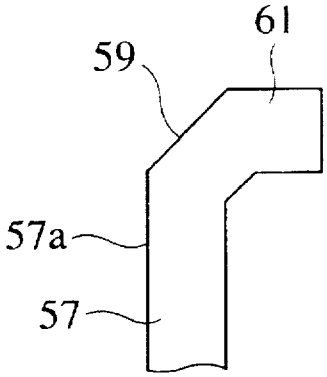
FIG. 5 is a side view of another preferred embodiment of a protecting wall portion of a female terminal according to the present invention.

As shown in FIG. 5, a protecting wall portion 57 may be used as the protecting wall portion for protecting the bent portion 39 of the resilient contact piece 37. This protecting wall portion 57 has an inclined plane 59 which is inclined from the front surface **57*a* toward the male-terminal receiving portion 49. The protecting wall portion 57 also has an extending portion 61 which extends toward the resilient contact piece 37**.

According to this preferred embodiment of the present invention, even if the male terminal 53 is inclined to be inserted into the male-terminal receiving portion 49, the extending portion 61 prevents the male terminal 53 from contacting the resilient contact piece 37. Even if the male terminal 53 is so inserted as to contact the resilient contact portion 37, it contacts the upper portion of the pinch preventing portion 45, so that it is possible to surely prevent the deformation of the resilient contact portion 37.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A female terminal formed by folding a piece of plate material, comprising:

a substantially quandrangular electrical contact portion having a bottom plate portion and an opening at front end and through which a flat male terminal is inserted for establishing an electrical connection between the male terminal and the female terminal;

a resilient contact piece in said electrical contact portion having a bent portion folded back from a front end of the bottom plate portion; and a protecting wall portion at said opening of said electrical contact portion for protecting said bent portion of said resilient contact piece, said protecting wall portion extending across a lower portion of the opening in front of the bent portion and having an upper edge at a level above the bent portion, said protecting wall portion covering a lower portion of said opening of said electrical contact portion.

2. A female terminal as set forth in claim 1, wherein said protecting wall portion has an extending portion which extends toward said resilient contact piece.

3. A female terminal as set forth in claim 1, further comprising a pinch preventing portion formed by bending a free end portion of said resilient contact piece downwards.

4. A female terminal as set forth in claim 2, further comprising a pinch preventing portion formed by bending a free end portion of said resilient contact piece downwards.

5. A female terminal as set forth in claim 1, wherein said protecting wall portion is formed by folding a pair of extending wall portions which extend from side wall portions of said electrical contact portion.

6. A female terminal as set forth in claim 1, wherein said protecting wall portion prevents said male terminal from contacting said bent portion.

* * * * *